United States Patent [19]

Rossman et al.

[11] 4,156,222

[45] May 22, 1979

[54] TRANSFORMER WITH DIVIDED PRIMARY

[75] Inventors: Christoph Rossman, Gauting; Erhard Lienke, Munich, both of Fed. Rep. of Germany

[73] Assignee: Commerzstahl Handelsgesellschaft mbH, Munich, Fed. Rep. of Germany

[21] Appl. No.: 763,129

[22] Filed: Jan. 27, 1977

Related U.S. Application Data

[63] Continuation of Ser. No. 595,280, Jul. 14, 1975, abandoned, which is a continuation of Ser. No. 536,901, Dec. 27, 1974, abandoned, which is a continuation of Ser. No. 250,693, May 5, 1972, abandoned.

[30] Foreign Application Priority Data

May 5, 1971 [DE] Fed. Rep. of Germany ..... 2122242
Apr. 20, 1972 [DE] Fed. Rep. of Germany ..... 2219335

[51] Int. Cl.[2] ..... H01F 27/24; H01F 27/30

[52] U.S. Cl. ..... 336/61; 336/96; 336/155; 336/184; 336/192; 336/198; 336/215

[58] Field of Search ..... 336/184, 198, 192, 96, 336/155, 234, 65, 214, 215, 165, 212, 214, 215, 217, 61

[56] References Cited

U.S. PATENT DOCUMENTS

| | | | |
|---|---|---|---|
| 1,553,983 | 9/1925 | Casper | 336/184 X |
| 2,317,602 | 4/1943 | Hall, Jr. et al. | 336/155 X |
| 2,418,642 | 4/1947 | Huge | 336/155 X |
| 3,129,377 | 4/1964 | Monroe et al. | 336/217 X |
| 3,189,772 | 6/1965 | Wingler et al. | 336/198 X |
| 3,237,127 | 2/1966 | Corey | 336/215 X |
| 3,354,417 | 11/1967 | Davis | 336/96 X |
| 3,566,322 | 2/1971 | Horbach | 336/198 X |
| 3,665,358 | 5/1972 | Leuck et al. | 336/96 |

FOREIGN PATENT DOCUMENTS

| | | | |
|---|---|---|---|
| 89889 | 11/1922 | Australia | 336/212 |
| 193434 | 2/1923 | United Kingdom | 336/165 |
| 347538 | 4/1931 | United Kingdom | 336/184 |
| 566221 | 12/1944 | United Kingdom | 336/234 |
| 1004594 | 9/1965 | United Kingdom | 336/184 |
| 1055808 | 1/1967 | United Kingdom | 336/65 |

OTHER PUBLICATIONS

Kleintransformatoren und Eisenkerndrosseln", Copyright 1970 by Vogel-Verlag, printed in Germany, Graphischer Betriels.

*Primary Examiner*—Thomas J. Kozma
*Attorney, Agent, or Firm*—Blanchard, Flynn, Thiel, Boutell & Tanis

[57] ABSTRACT

A three legged transformer in which the legs are all of the same height and in which the primary winding is divided into two parts, one of the parts being wound upon one of the legs and the other part being wound upon another leg, and in which the secondary winding is wound upon the third leg.

15 Claims, 6 Drawing Figures

TRANSFORMER WITH DIVIDED PRIMARY

This is a continuation of application Ser. No. 595,280, filed July 14, 1975, now abandoned, which is a continuation of Ser. No. 536,901, filed Dec. 27, 1974, now abandoned, which is a continuation of Ser. No. 250,693, filed May 5, 1972, now abandoned.

FIELD OF THE INVENTION

The subject invention relates to a transformer with at least a three leg core and separate switchable windings. Known transformers of this kind, particularly in the smaller size, have certain disadvantages which limit the power and the structure height. With the development of printed circuits, transformers with relative low power, low losses and small structure heights because necessary.

BACKGROUND OF THE INVENTION

The present available smallest transformer for a primary voltage of 220 volts and 50 $H_z$ has a structue height of 26 mm. A smaller structure height is not economical, because to arrive at the necessary number of windings, awire diameter of less than 0.05 mm would be required.

The standard sizes of transformer laminations which limits the winding space also tend to limit possible size reduction in transformers. This in turn increases the danger of voltage breakdown between the primary and the secondary winding. A special insulation between the windings which has a dielectric strength up to about 2500 volts cannot be installed because of space limitations. The maximum power output of such a small transformer with a standard core EI 30*a* is about 1.2 VA with an efficiency of about 42%.

The known transformers have bad heat train characteristics due to their compact construction which is aggravated by having the primary and secondary winding wound on top of each other. The heat generated in one winding is directly transferred to the other winding. Furthermore, due to the limited winding space given by the laminations, the specific current in relation to the winding area is limited, so that the temperature conditions with increase of of power quickly become worse.

In particular for small transformers which should be suitable for installation on printed circuit boards, it is very desirable that they can be potted into a cup shaped housing. Mounting transformers by solder points on printed circuit boards, caused from powers of about 10 VA on, strong mechanical stresses and special clamping elements become necessary. Furthermore, the structure height of such transformers which is usually around 40 to 60 mm is excessive because standard construction heights for printed circuit boards are 12, 15, 18, and 22 mm. For contemporary transformers with acceptable efficiencies, such construction heights cannot be realized. Furthermore, the compact construction of the transformers causes a too large weight per area ratio. This weight could be reduced by a small amount if the potting of the transformer is omitted. In this case however the windings would be exposed to all outside influences such as humidity, acid mist, oxidation, etc. Furthermore, the danger of receiving an electric shock is increased since components under voltage can easily be touched. The reason for the above outlined disadvantages are caused mostly by the fact that the primary winding and the secondary winding are wound on top of each other on the center leg of the contemporary three-legged transformer. Furthermore, with this configuration, a high capacitive and inductive action exists between the primary and secondary winding. The capacitive coupling can be prevented with the insertion of a conductive foil between the two windings. If such a screen is inserted the capacity between primary and foil on one side and the capacity between foil and secondary winding on the other side will become high. At the same time the disadvantage of relative high leakage current over the foil can occur when one winding burns through.

Having the primary and secondary winding on top of each other and directly coupled with each other, in the known three-legged configuration, super-imposed high frequencies will be transferred between the two windings. This would be impossible if the coupling between the windings would go exclusively through the iron core. The iron core is not suitable for depolarization by high frequency currents. To make the transferred high frequency harmless on the secondary side, to protect for instance rectifiers, additional components are necessary such as capacitors across the rectifiers. Thus the sensitivity to malfunctioning will be increased in network systems.

The current pulse when switched can, depending on the switching moment and the phase of the primary current, be a multiple of the average current. The safety margin on the primary winding therefore is difficult to ascertain. Furthermore, the safety precautions can only be to a limited degree so that they are not very effective. By secondary rectification the rectifier has to be protected by a resistance in series which in turn will increase the number of potential malfunctioning components.

Another disadvantageous property of contemporary transfomers occurs at short circuit. If the transformer is not able to carry short circuit currents, it will burn through. To make it capable of carrying short circuit currents some components like thermal switches, nonlinear resistors, etc., must be installed, which in turn will again increase the sensitivity for malfunction, or more powerful transformers of larger dimensions and weight must be used. Secondary voltage regulation is possible with contemporary transformers by changing the primary voltage. For this high power regulation resistors or other complicated mechanical means must be employed to change the primary voltage.

SUMMARY OF THE INVENTION

It is the object of this invention to create a transformer which avoids the above outlined disadvantages and can be operated at higher power having less weight than the contemporary transformer.

A transformer of the kind as mentioned at the beginning solves the problem that the primary winding is split into at least two part windings which are wound each on an individual transformer leg and that at least one secondary winding is placed on another transformer leg.

A transformer conforming with the invention uses a core with at least three legs, whereby each leg carries one winding in such a way that the primary winding is split into two part windings which are wound on separate legs, their winding space is split in two part winding spaces, which are not then placed on the same leg as the secondary winding. Out of this results a much better winding space utilization with the three-legged core, the ordinarily empty outside legs of the contemporary type transformer carry some windings also. The primary windings can be installed in series or in parallel and generate a magnetic flux, which in turn induces in the secondary winding, placed on a separate leg, a secondary voltage.

Hence with simple switching the primary voltage can be cut in half respectively doubled by keeping the power values constant.

If the windings are placed on the transformer legs in a suitable way and the leg area is chosen correctly, the most favorable magnetic flux distribution in the leg of secondary winding can be achieved. This will allow an optimum utilization of the core iron, which will be further explained later. Because the windings are separated from each other and are placed on individual transformer legs, the winding need not to be wound upon each other any more thus a much higher breakdown voltage can be achieved. To generate an arc between the windings which are placed beside each other, a much greater voltage is necessary. Furthermore due to the separate placement of the windings beside each other, a very small capacity between the primary and secondary winding results so that no direct coupling between the windings exists. The inductive coupling of the windings is now to a larger portion through the iron core than with the contemporary type three legged transformers. Thus a transfer of high frequency energy is not possible. Thus special elements to protect rectifiers on the secondary side can be avoided. Because the inductive coupling takes place only through the iron core of the transformer, a higher internal resistance results at the transformer than with the contemporary type transformer. Thus an inherent short circuit current limitation results which in case of a short circuit will protect the transformer from destruction.

An important advantage of a transformer conforming with the invention is that for all the windings much less copper is needed than with the contemporary three legged transformers. The primary windings are distributed on two separate legs, so that the winding thickness is less and thus the average winding length is shorter. The same is true for the secondary winding also, because it is wound directly on another leg and not on top of the primary winding. Thus the average winding length of the secondary winding is likewise shorter. For each leg, less winding space is used, so that in deviation of standard core laminations winding cross sections can be realized, which allow a more favorable formation of the iron-copper ratios. Furthermore, the structure height of the transformer can be reduced.

For a transformer conforming with the invention, many differnt construction forms can be envisioned. The legs need not lay in the same plane, they can spacewise be in any order; also their number is not limited to three legs. The principle of splitting the primary winding can be realized also for more than three legs as long as they are connected through yokes to the secondary winding in likewise fashion as contemporary transformers.

Another feature of the invention is that the average line of force length of the magnetic flux generated in the first primary part winding has the same average length as the line of force generated in any other primary part winding passing through the same secondary winding. This feature can be applied especially with a core which has three legs in the same plane, where the primary windings are wound on the two outside legs. Thus, it is possible to construct the transformer in a manner that a small structure height results. If for such a transformer a core is used with the usual EI-section and the usual core height, the cross section of the two outside legs will become rectangular while the cross section of the center leg becomes a square. Due to the more favorable distributed winding space, a higher power output with a better temperature distribution can be achieved especially in the primary winding whereby the cross section of the secondary winding flux path has the magnitude of the sum of the cross sections of the two legs which carry the primary windings. The higher power output appears also on the secondary side because, due to more favorable winding space, a better utilization of the iron takes place due to the increased magnetic flux. The known transformer cores allow a higher power output as can be realized with the present possible winding cross section with a safe temperature distribution.

Another feature of a transformer conforming with the invention is that the legs, which carry the primary windings, have a square cross section. This cross section comes close to the ideal circular cross section so that an optimum transfer of electrical power from the primary windings into magnetic power, is possible. The cross section of the leg carrying the secondary winding is large enough to absorb the magnetic flux produced in the two primary windings. A transformer which is built according to the above outlined construction form conforming with the invention, can be built very well as a small transformer suitable for insertion into printed circuit boards where a particular low structure height is necessary. For this it is advantageous to develop the concept further so that the transformer with square sections of the outside legs has a rectangular cross section on the leg carrying the secondary winding, and that the height is identical with the height of the square cross section of the leg carrying the primary winding.

If such a transformer is built up from standard M or EI laminations, a core cross section results where the two outside leg sections are square and the center leg section is formed by two side by side squares.

Using such a layered core whose structure height is half the magnitude than the core layered in the usual way, it is possible by using standard quality lamination to build a transformer with a structure height, including the windings of about 12 mm, whereby a power output of 3 VA is possible. A transformer conforming with the invention can be realized with different goals in mind. By using standard core material of usual size, a transformer equal in size to the contemporary transformer but with increased power output, can be realized due to more favorable winding space, shorter average winding length and larger wire diameter and more favorable temperature distribution.

On the other hand, by removing the power gain, the layer height of the used core can be reduced, so that the structure height is lowered even further beyond what already is possible by using the usual core material. Thus, the invention offers a considerable improvement for transformers of any kind and size.

A transformer conforming with the invention is best constructed so that neighboring windings are wound in opposite directions to each other. Thereby, the transmission of high frequency disturbance from the primary to the secondary winding can be suppressed so far that they will not have any detrimental effect on the secondary side.

Furthermore, it is possible to build up a transformer where the layer height of the core is smaller than the width of the leg which carries the secondary winding and its cross sectional area is smaller than the sum of the cross sectional areas of the two legs carrying the primary winding.

On one side of a lower layer height of the lamination will result and the cross section of the legs with the primary winding will turn out to become about square shaped, on the other side in deviation of the standardized laminations, a leg cross section for the secondary winding is proposed which is smaller than the sum of the cross sections of the legs for the primary winding. These two measures make it possible to build transformers whose core has half of the layer height. In view of possible power output compared to contemporary transformers and that for the previously outlined construction form, more improvements are possible. It is important to recognize that, in a transformer conforming with the invention, a relatively small portion of the total transformer core can be put under higher load, without having a considerable decrease in the overall efficiency.

It is also important that the two primary windings can generate the required total magnetization almost without losses. This means that the core cross sections for the primary windings are dimensioned square shaped in a way that the transformer iron does not become saturated when magnetized. Based upon standard lamination dimension, the iron volume saved on the leg at the secondary winding an be added to the legs with the primary windings, or by using standard laminations, a material strip could be removed out of the center of the leg with the secondary winding so that this cross section reduction is equal to the section reduction experienced at the leg with the primary windings. Thus, a transformer lamination is created with larger windows and whose width is equal to the width of the outside legs. These dimensions are almost identical with the dimension of standard lamination in the same power classification. The increased width of the outside legs will allow a decrease in the number of windings and, in connection with the larger windows, a larger wire diameter can be used, so that the temperature under operating conditions decreases and the efficiency increases.

If the magnetic flux generated by the primary windings is concentrated in the leg cross section for the secondary winding, which is smaller than the sum of the leg cross sections of the primary windings, an increased induction results in the leg of the secondary winding, compared to the other portion of the transformer core. This increased induction is produced with normally loaded primary windings and its normally dimensioned leg cross sections, so that the temperature conditions of the primary transformer part also remain normal. In the area of the leg with secondary winding, a secondary winding can be installed which is in view of space requirements smaller dimensioned, due to the smaller leg cross section as normally required for the power output and on the larger cross section mounted secondary winding. The logically increased operating temperature will be reduced to acceptable values through the relative cool remaining portion of the transformer. Following this principle transformers can be realized with higher power output or lower temperatures with equal power as transformers with leg cross sections which at every point have a constant magnetic induction value.

It has been shown, that compared to the usual dimensioning practice, a decrease of the leg cross section for the secondary winding is possible to about $\sqrt{2}$ times the leg cross sections of the primary windings. Compared to a cross usual section ratio of 1:2, the winding space available becomes larger with a cross section ratio of 1:1.4–1:1.5, so that considerable larger wire diameters for the primary windings can be used. Through the improvement of the windings resistance, an increased efficiency will result with normal temperature conditions. There are further improvements possible if core oriented transformer laminations are used, which in the longitudinal direction of the legs have a preferred direction for magnetization. This is true especially in the construction form with a narrow secondary winding leg because this leg is under relatively high load.

A transformer constructed according to the present invention, can furthermore easily be equipped to regulate the voltage. This can be realized in different ways since the primary windings are split in two parts. It is, for instance, possible to connect the primary windings through a phase shifter relative to each other. Such a phase shifter can, for instance, be an inductive or capacitive element, an electric phase shift switching network or a resistive circuit. If the primary part windings are fed with part voltages with different phase angle through such a phase shifting device, a magnetic flux will appear in the leg with the secondary winding, which is the sum of the fluxes produced in the primary windings with different phase angles. Since the sum of the fluxes is formed vectorially, its magnitude can be changed by merely changing the phase angle. The secondary voltage will change proportionately. Therefore, it is possible to regulate the voltage of the secondary winding of a transformer without incurring additional losses. Another kind of voltage regulation with a transformer conforming with the invention is also possible, if the secondary winding is additionally magnetized with direct current. Thus a constant magnetic flux is superimposed on top of the flux produced by the primary winding in the leg of the secondary winding. This superimposed flux influences the magnetic field to a higher degree in the leg with the secondary winding than flux generated in the primary windings. Equivalent action can be observed with this setup with different direct current magnetization, different values of secondary voltages will appear. The setup for direct current magnetization can be further developed out of the above outlined construction form, at the transformer possible switching elements can be incorporated which rectify part of the secondary alternating current. No active current source on the secondary winding is necessary for this. A portion of the secondary alternating current can be rectified. Thus, a direct current component will flow in the secondary winding and produce the desired direct current magnetization in the leg of the secondary winding.

A further advantageous property of a transformer conforming with the present invention is that it can very simply be built as a phase shifter.

For this another secondary winding is placed on a leg carrying a primary winding, and the first secondary winding is loaded with an adjustable resistor. It is then possible to vary the number of turns of both primary part windings in a manner that they produce a magnetic flux of different magnitudes. Thus the magnetic flux distribution in the total transformer core may be changed, especially in the leg of the first secondary winding. The magnetic flux generated in one primary winding will then be conducted through the leg with the first secondary winding, and the remaining portion of the magnetic flux flows through the remaining leg on which the second primary winding is placed.

This second primary winding generates its own magnetic flux, which preferably should be smaller than the flux from the first primary part winding. By having the windings wound correctly and the primary and secondary winding connected correctly, the two magnetic fluxes will be superimposed on each other and will also oppose each other. Depending on the adjustment of the resistance at the first secondary winding, the two magnetic fluxes will oppose each other, so that the phase angle of the output voltage of the second secondary winding is changed in an analog fashion. Suprisingly, the amplitude, with a phase shift of 90°, the voltage at the second secondary winding falls only to two-thirds of the voltage of amplitude with a phase angle of 0° or 180°.

It is furthermore possible to operate a transformer conforming with the invention as a frequency mixer whereby the frequencies to be mixed are fed into the two primary windings and the product can be taken from the secondary winding. For this the very small interaction between the primary windings is important. This is achieved through the favorable distribution of the two magnetic fluxes generated in the primary windings.

BRIEF DESCRIPTION OF THE DRAWING

In the following the invention is described with the aid of construction examples which are compared with the properties of contemporary transformers using these figures.

DETAILED DESCRIPTION

Figure 1:
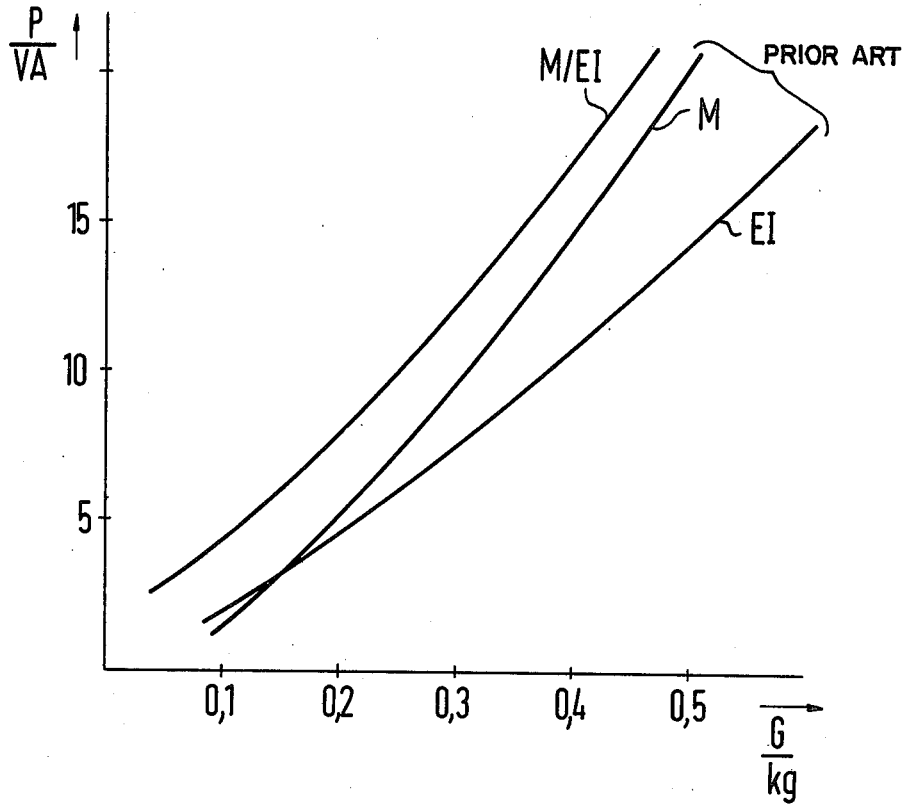
FIG. 1 A graphic outline of the power output versus weight of small transformers with M and EI - including a transformer built conforming with the invention.

In FIG. 1 the power output versus the total weight of a transformer is given, whereby a power range from 0 to 20 VA with a weight up to 0.5 Kg is shown. Three curves are shown. The two lower ones are representing a three legged transformer wound in contemporary fashion with M - or EI cores. The upper curve labeled M/EI represents a transformer conforming with the invention. The graphic outline in FIG. 1 shows that a power increase of nearly 100% is possible in the lower power range. For example, with a transformer weight of 150 g with a contemporary transformer only an output of 3 VA can be achieved, while with the configuration conforming with the invention, an output of about 6 VA is possible. With increasing power and transformer weight, the properties of the M - core become better but there is still a higher power output possible with a transformer construction conforming with the invention. The advantage becomes smaller with increasing transformer size, because, as well known, the losses become percentage-wise smaller with increasing core size. The outline shows clearly that the invention especially for transformers with small power outputs offers considerable advantages—such as lower construction height with increased power output.

Figure 2:
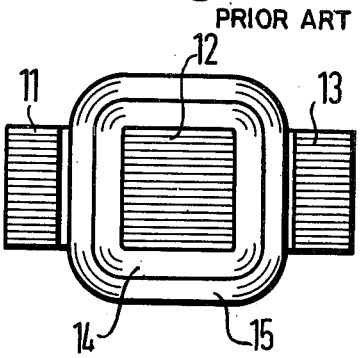
FIG. 2 Cross section of a three legged transformer wound in contemporary fashion.

In FIG. 2 a three legged transformer with M - or EI core wound in contemporary fashion, is shown. The transformer cross section is shown, its outside legs 11 and 13 have a rectangular cross section, its center leg 12 has a square cross section, because the square form is closest to the ideal circular form. Yoke portions connect the ends of the legs 11, 12 and 13 to define a pair of substantially rectangular windows. The winding space is given by the window size of the lamination between the two core legs. When the secondary winding 15 is wound on top of the primary winding 14, the previously described disadvantages result. The total structure height of the transformer is determined by the thickness of the windings. This in turn is determined by the height of the lamination package of the core.

Figure 3:
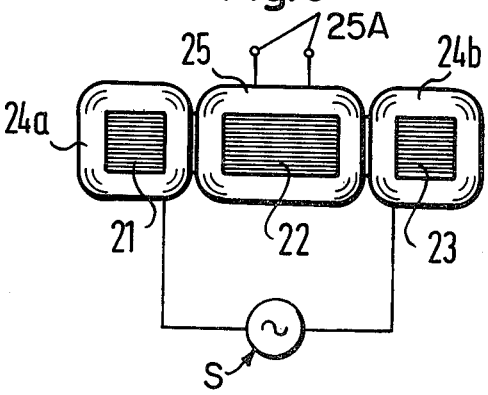
FIG. 3 Cross section of a transformer conforming with the invention.

In FIG. 3 a cross section of a transformer is outlined which conforms with the invention. The outline shows the construction in which the core lamination package height is used, where the outside legs 21 and 23 are square shaped. By using standard laminations with M - or EI - cross section, a transformer core is created with square outside legs 21 and 23, and a rectangular shaped center leg 22 whose cross sectional area is equal to approximately $\sqrt{2}$ of the cross sections of either of the outside legs 21 or 23. The primary winding is connected to a suitable source of electrical energy S is split into two parts, **24*a* and 24*b*, and wound around the outside legs, 21 and 23. The secondary winding 25 is wound on the center leg 22 and terminates at output terminals 25A. It can be seen that with the same winding height as the transformer in FIG. 2, a lower structure height of the total transformer results, whereby the winding space formed by the lamination windows, is completely utilized. The average winding length of the individual winding is considerably shorter compared to the winding length shown in FIG. 2; thus the amount of copper wire needed is considerably reduced. In a transformer according to FIG. 3, the primary windings 24*a* and 24*b* generates magnetic fluxes which coincide in the center leg 25 and then flow through the cross section of the secondary winding 25**. Through the symmetric construction of the total transformer in FIG. 3, the flux conditions are very clear, and obvious to those skilled in the art. Furthermore, it can be seen that the secondary and the primary winding confront each other over a much smaller area than in the transformer type shown in FIG. 2. Thus, the capacitive and inductive influences of the windings upon each other are much lower than contemporary transformers. Furthermore, the danger of voltage breakdown is considerably lower with the present invention, since the primary winding is split into two parts of which only a small portion is near the secondary winding. In contrast to the construction form shown in FIG. 3 conforming with invention, non-standard laminations can be used also. Thus further improvements are possible, e.g. if the ratio between copper weight and iron weight of the transformer is taken into consideration, this ratio can be considerably improved due to the available window space. It is for instance possible that the cross sections of the outside legs be made rectangular. This could result in lowering the height of the lamination package further. Thereby, the ratio between the window spaces would be changed also and a further improvement of the ratio between losses and useful power could result.

Figure 4:
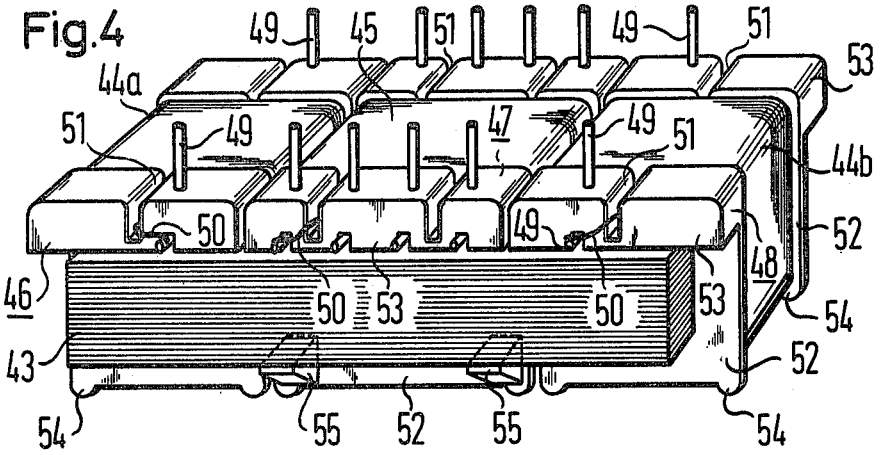
FIG. 4 A perspective view of a transformer conforming with the invention which is especially suitable for insertion into a printed circuit.
Figure 5:
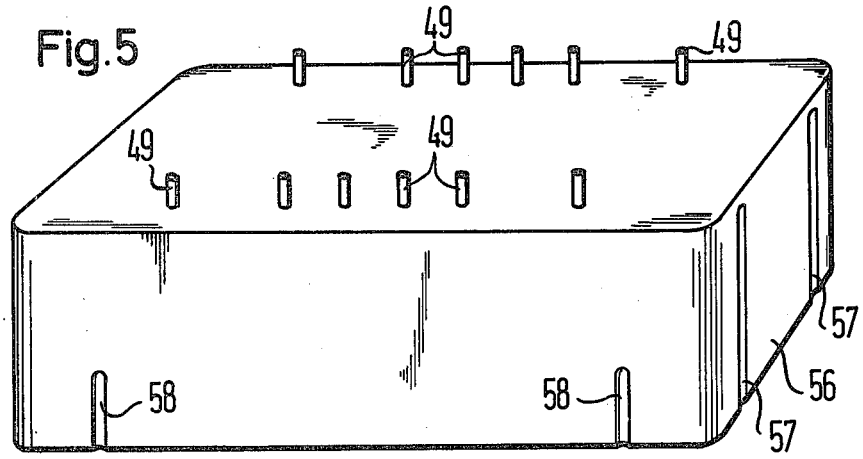
FIG. 5 A perspective view of the transformer shown in FIG. 4 after potting.

In FIG. 4, a transformer conforming with the invention is shown in perspective without the potting. This transformer carries three bobbins 46, 47, and 48, which carry the primary windings 44*a* and 44*b*, and also the secondary winding 45. The bobbins 46, 47, and 48 are placed upon the transformer core 43. From the perspective outline can be seen that the cross section of the center leg has about $\sqrt{2}$ times the value of the square cross section of the outside legs. The bobbins 46, 47, and 48 are equipped with flanges 52 which carry a holding structure 53 on the upper edges, which is used to anchor rectangular bent contact pins 49. The contact pins 49 are placed in the holding structure 53 so that one part protrudes rectangularly through the top, while their rectangular second part protrudes horizontally thru the side. To the latter part of the contact pins 49, the winding end will be connected. To guide the ends of the windings 50 to the contact pins, a groove 51 is provide in the holding structure. It can be seen that with this configuration of holding structure 53 and contact pins 49, distribution of the contact pins in the form of a raster is possible, so that the total transformer can be easily inserted in a raster-like circuit board. In case that not all the contact pins are connected to the ends of windings, they will serve as additional clamping elements. The flanges 52 of the bobbins 46, 47, and 48, are on the lower edges equipped with small noses 54, which make it possible to pot the total transformer without a cup shaped housing. The transformer can directly be placed in the potting mold and potted in this form, so that a prism shaped body results. The small noses 54 keep the transformer out of contact with the surface of the potting mold, so that the potting material surrounds the transformer almost completely with the exception of the small points of contact where the noses 54 touch the mold. The bobbin 47 for the secondary winding 45, which is placed in the center of the transformer, carries furthermore on its flange 52 in the area opposite the holding structure 53, small wedge shaped supports 55 which hold the last lamination of the transformer core 43 tight to the core. The transformer, with the winding configuration as outlined, is suitably built up from EI - laminations, so that the I portion would fall off without the wedge shaped supports 55. The supports hold this portion of the lamination to the core 43 so that no special glue is necessary, which could disturb the potting process respective the finished potted transformer structure. In FIG. 5, a finished potted transformer conforming with the invention is shown. The potted body 56 is prism shaped and can be formed with rounded edges. The contact pins 49 protrude through the top surface, so that they can be inserted into the raster holes on the printed circuit board and be soldered. The transformer also has outside grooves 57 and 58, which decrease the operating temperature by increasing the surface area and permitting better heat radiation. Any desired number of grooves can be placed on the outside to achieve a better heat dissipation.

In the course of attempting to achieve the lowest possible operating temperature, it became obvious that the material and the shape of bobbins is also a determining factor. When the transformer is potted, a potting compound must be chosen which has a high heat conductivity. Therefore it is important that good heat conductive elements are placed between the mass of potting material and spots which are not directly covered by the potting material, to prevent the containment of heat inside the transformer. The bobbins and, especially their flanges, are such elements. They should be made from heat conductive plastic to prevent heat flow from the core to the windings and, in addition, to absorb the heat generated in the windings in their flanges. If the bobbin material has a heat conductivity equivalent to the potting material, the windings will not heat up through the core and they will retain their power because of the relative moderate operating temperatures. Approximately the described holding structure fills up the total free space between the core and the flanges of the bobbins. In this way locations with a relative high heat capacity are formed which will improve the above described effect.

If they are equipped with grooves, the winding ends are better locked in place due to the length of the holding structure, as when the winding end is just guided through a notch in the flange of the bobbin.

In deviation from the described construction example, the holding structure can be placed on other or all free outside sides of the bobbin flanges to further increase the heat conductivity properties. In this manner the wedge shaped supports 55 can be eliminated. The contact pins can also be installed in any desired location of the transformer whereby, as already mentioned, they can also serve the purpose of additional clamping pins. Furthermore, the holding structure can be used without having the contact pins installed.

Figure 6:
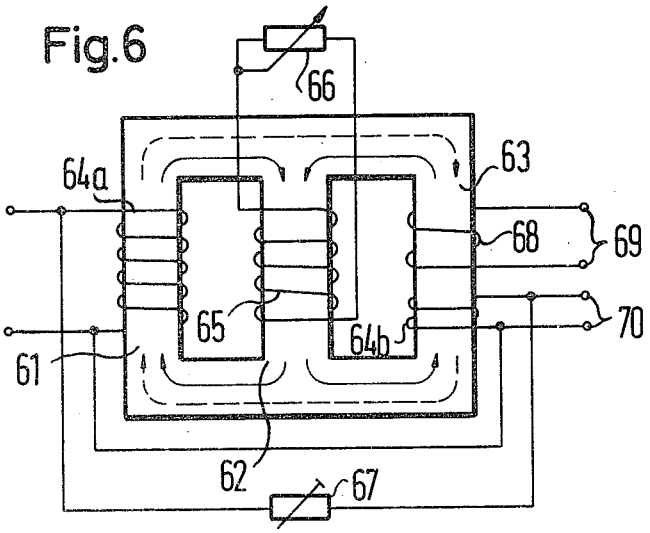
FIG. 6 The windings configuration of a three legged transformer built as a phase shifter conforming with the invention.

In FIG. 6, a construction form of a transformer conforming with the invention is outlined, where a second secondary winding 68 is installed. On the outside leg 61 the primary winding 64*a* is placed, while on the outside leg 63, the primary winding 64*b* is placed. The windings are connected in parallel and an adjustable resistor 67 is installed between the windings. On the center leg 62, the secondary winding 65 is installed, which is loaded with an adjustable resitor 66. With this arrangement the resistive load on the secondary winding can be changed between short circuit and minimum load. On the outside leg 63 is mount an additional winding 68 with terminals 69. In operation a phase shifted voltage appears at terminals 69 in regard to the primary voltage. The primary winding 64*b* has as compared to the primary winding 64*a*, less windings and therefore generates in the leg 63*a* a weaker magnetic flux than the primary winding 64*a* on the leg 61. The windings are polarized, so that the magnetic flux generated in the primary winding 64*b* opposes the magnetic flux generated in the primary winding 64*a*. With the adjustable resistor 67, adjustments of the magnetic flux generated in the primary winding 64*b*, is possible. Thereby in The illustrated configuration the following function will appear by adjusting the resistor 66. If the secondary winding 65 carry a minimum load, the flux distribution is shown by the solid lines. The transformer works then in the mode, as already described in the explanations for FIG. 3.

On the secondary winding 68, a secondary voltage appears which essentially is determined by the magnetization of the leg 63 by the primary winding 64*b*. If the resistance 66 on the secondary winding 65 is changed into the short circuit position, the center leg 62 of the transformer will more and more become saturated with magnetic flux and a flux distribution results as shown by the dashed lines. The primary winding 64*a* generates a magnetic flux, which flows less and less through the center leg 62 and thus is conducted through the outside leg 63. This flux opposes the flux generated in the primary winding 64*b*. Thus the voltage on the secondary winding 68 becomes smaller and has a phase angle which is not controlled by the flux generated in the primary winding 64*a*, but rather is now determined by the flux generated in the primary winding 64*a*. It can be seen that by changing the resistance 66 between short circuit and minimum load of the secondary winding 65, the phase angle in the secondary winding 68 voltage, may be varied between 0° and 180° is possible. As already explained, the amplitude change of the voltage appearing at the terminals 69 is small in its worst case with a phase shift of 90°; the voltage is two-thirds of the voltage with a phase shift of 0° and likewise for 180°.

The phase shifting action can also be influenced through a voltage which is fed through the terminals 70 into primary winding 64*b*. This can be either an alternating voltage or a DC - voltage. With this arrangement further variation in regard to the voltage appearing at terminal 69 can be achieved.

The embodiments of the invention in which an exclusive property or privilege is claimed are defined as follows:

1. A transformer having a core with at least three limbs of equal height connected by yoke means at both ends thereof to define a pair of windows, first winding means which is divided into two separate windings each of which is disposed on a separate limb of said core and at least one second winding means on the third limb which is affected by the sum of the flux lines generated by said first winding means, the height of the core being smaller than the width of the limb carrying said second winding, the cross-sectional shape of the limbs carrying said first winding means being approximately square, comprising the improvement of means for effecting a flux density in said third limb greater than the flux density in each of said separate limbs, said means consisting of the cross-sectional area of the limb carrying said second winding being 25% to 30% smaller than the sum of the cross-sectional areas of the separate limbs carrying said first winding means whereby when said first winding means are the primary windings for said transformer and are connected so that the magnetic flux lines in each of said outer legs which flow into said intermediate leg are added in said intermediate leg, the flux density in said third limb is greater than the flux density in each of said limbs carrying said first windings and whereby said first windings are dimensioned according to the energy transformable in the volume of the limbs carrying them.

2. The transformer of claim 1, wherein a winding free spacing is provided between each of said windings and said yokes; and including a plurality of bobbins made from light heat conductive plastic material, each of said bobbins having a flange and a holding structure having a plurality of contact pins thereon, the cross-sectional thickness of said flange filling in said winding free space between said windings and said yokes.

3. The transformer according to claim 2, including a support affixed to at least one of said flanges of at least one of said bobbins, said support having a flat surface in a spaced apart parallel relationship with an opposed flat surface on said holding structure, said opposed surfaces on said support and said holding structure engaging opposite side surfaces of at least one of said yoke means.

4. The transformer according to claim 3, wherein said flanges of each of said bobbins have a plurality of small noses which lay in the same plane as said flanges.

5. The transformer according to claim 3, wherein at least one of said holding structures has at least one side with a plurality of grooves therethrough, said grooves adapted to guide the ends of said windings to said contact pins.

6. The transformer according to claim 2, wherein said contact pins project perpendicularly outward and away from said one side of said holding structure.

7. The transformer according to claim 6, including a heat conductive potting material having a plurality of cooling grooves therein, said potting material completely surrounding said transformer with the ends of said contact pins projecting from said one side terminating outside said potting material.

8. The transformer of claim 1, wherein the width of the space between adjacent limbs in each window is approximately equal to the width of each of the limbs carrying said first winding means.

9. The transformer of claim 1, wherein said core consists of laminates.

10. The transformer of claim 1, wherein adjacent windings on said limbs are wound in an opposite rotational direction.

11. A transformer construction, comprising:

a magnetic core including first and second outer leg portions, an intermediate leg portion and yoke portions connecting the ends of said leg portions to define two substantially rectangular windows;

separate first and second winding means electrically connected together, only said first winding means being wound only on said first outer leg and only said second winding means being wound only on said second outer leg; and a single third winding means wound only on said intermediate leg portion, said first and second winding means being wound in such a sense that the power flux generated by said first and second winding means are added in said intermediate leg, means for effecting a flux density in said intermediate leg greater than the flux density in each of said first and second outer legs, said means consisting of the cross-sectional area of said intermediate leg portion of said magnetic core being in the range of from 1.4 to less than 2 times the cross-sectional area of each of the cross-sectional areas of said first and second outer leg portions whereby the flux density in said intermediate leg produced by said power flux generated by said first and second winding means is greater than the flux density in each of said first and second outer legs and each of said first and second winding means being dimensioned according to the energy transformable in the volume of the respective one of said first and second outer legs on which they are wound.

12. A transformer construction according to claim 11, wherein the total weight of said transformer is in the range of up to and including 0.5 kg. to thereby facilitate its use on a printed circuit board.

13. A transformer construction, comprising:

a magnetic core including first and second outer leg portions, an intermediate leg portion and yoke portions connecting the ends of said leg portions to define two substantially rectangular windows;

separate single first and second windings electrically connected together, only said single first winding being wound only on said first outer leg and only said single second winding being wound only on said second outer leg; and a single third winding wound only on said intermediate leg portion, means for effecting a flux density in said intermediate leg greater than the flux density in each of said first and second outer legs, said means consisting of the cross-sectional area of said intermediate leg portion of said magnetic core being in the range of from 1.4 to 1.5 times the cross-sectional area of each of the cross-sectional areas of said first and second outer leg portions, said first and second windings being wound in such a sense that the power fluxes generated by them in each of said outer legs flows into said intermediate leg are added in said intermediate leg, the flux density in said intermediate leg produced by said first and second windings being greater than the flux density in each of said first and second outer legs and each of said first and second winding means being dimensioned according to the energy transformable in the volume of the respective one of said first and second outer legs on which they are wound whereby said energy transformed into said first and second outer legs will be less than saturation and whereby the extra heat generated in said intermediate leg, due to the purposeful small construction thereof, tends to be dissipated into the cooler first and second outer legs.

14. A transformer construction, comprising:

means defining a source of electrical energy;

a magnetic core including first and second outer leg portions, an intermediate leg portion and yoke portions connecting the ends of said leg portions to define two substantially rectangular windows;

separate first and second winding means electrically connected together, only said single first winding means being wound only on said first outer leg and only said single second winding means being wound only on said second outer leg; and a single third winding means wound only on said intermediate leg portion, said first and second winding means being connected to said source of electrical energy to produce magnetic flux lines in each of said outer legs which flow into said intermediate leg and which are added in said intermediate leg whereby said third winding means defines a secondary winding and said first and second winding means define a primary winding, means for effecting a flux density in said intermediate leg greater than the flux density in each of said first and second outer legs, said means consisting of the cross-sectional area of said intermediate leg portion of said magnetic core being in the range of from 1.4 to less than 2 times the cross-sectional area of each of the cross-sectional areas of said first and second outer leg portions whereby the flux density in said intermediate leg produced by said first and second winding means is greater than the flux density in each of said first and second outer legs and each of said first and second winding means being dimensioned according to the energy transformable in the volume of the respective one of said first and second outer legs on which they are wound.

15. A transformer construction, comprising:

a magnetic core including first and second outer leg portions, an intermediate leg portion and yoke portions connecting the ends of said leg portions to define two substantially rectangular windows;

separate first and second winding means electrically connected together, only said first winding means being wound only on said first outer leg and only said second winding means being wound only on said second outer leg, each of said first and second winding means being dimensioned according to the energy transformable in the volume of the core material of the respective one of said first and second outer legs on which they are wound and thereby defining primary windings for said transformer construction; and a single third winding means wound only on said intermediate leg portion, said first and second winding means being additionally wound in such a sense that the power flux generated by said first and second winding means are added in said intermediate leg, means for effecting a flux density in said intermediate leg greater than the flux density in each of said first and second outer legs, said means consisting of the cross-sectional area of said intermediate leg portion of said magnetic core being in the range of from 1.4 to less than 2 times the cross-sectional area of each of the cross-sectional areas of said first and second outer leg portions, the power flux generated by said first and second winding means added in said intermediate leg producing a flux density in said intermediate leg which is greater than the flux density in each of said first and second outer legs, said third winding means defining a secondary winding for said transformer construction.

* * * * *